United States Patent [19]

Wolff et al.

[11] 4,082,147

[45] Apr. 4, 1978

[54] METHOD AND APPARATUS FOR A SURFACE CONTROL SYSTEM FOR: SUBSURFACE SAFETY VALVES

[75] Inventors: Danny K. Wolff; James D. Mott; Kenneth W. Colvin, all of Houston, Tex.

[73] Assignee: Hydril Company, Tex.

[21] Appl. No.: 771,465

[22] Filed: Feb. 24, 1977

[51] Int. Cl.[2] ..... E21B 43/00; E21B 33/03

[52] U.S. Cl. ..... 166/314; 166/53; 166/72; 166/323

[58] Field of Search ..... 166/72, 53, 323, 314, 166/315

[56] References Cited

U.S. PATENT DOCUMENTS

| | | | |
|---|---|---|---|
| 2,998,070 | 8/1961 | Tamplen et al. | 166/72 |
| 3,078,923 | 2/1963 | Tausch | 166/72 |
| 3,517,688 | 6/1970 | Scholle | 251/63.6 |
| 3,531,078 | 9/1970 | Hose et al. | 251/63.6 |
| 3,675,720 | 7/1972 | Sizer | 166/322 |
| 3,696,868 | 10/1972 | Taylor, Jr. | 166/315 |
| 3,870,102 | 3/1975 | Mott | 166/72 |

*Primary Examiner*—James A. Leppink

*Attorney, Agent, or Firm*—Pravel, Wilson & Gambrell

[57] ABSTRACT

Two embodiments of a surface controller system apparatus and their method for use with a surface controlled subsurface safety valve are disclosed. Both surface controller systems are responsive to an emergency shutdown signal for enabling closing of the subsurface safety valve when the well surface safety systems are shut-in. Once the subsurface Safety Valve has been shut-in up the system, the safety control system must be manually reset before the subsurface valve can be reopened.

Both safety control system provides an enclosed reservoir or accumulator for receiving the hydraulic control fluid when the subsurface valve closes and for containing well blow-outs through either one or both control fluid conduits operably connecting the controller system with the subsurface valve. The enclosed systems are also arranged that any internal leakage of the surface control system will operate to shut-in the well with the subsurface valve. Undesired pressure buildup, effecting possible operation of the subsurface valve in either of the normal or vent control lines also automatically operates to shut-in the subsurface safety valve.

16 Claims, 8 Drawing Figures

METHOD AND APPARATUS FOR A SURFACE CONTROL SYSTEM FOR: SUBSURFACE SAFETY VALVES

BACKGROUND OF THE INVENTION

This invention relates to the field of the surface controllers for automatic control of subsurface safety valves used in hydrocarbon producing wells.

The desirable capability for shutting in a hydrocarbon producing well with a controllable valve at a subsurface location has long been recognized. Such desirability resides in the personnel and equipment safety benefits as well as the prevention of damage to the environment from escaping hydrocarbons. When such wells are located offshore this desirability becomes a necessity.

U.S. Pat. No. 2,518,795 to Knox discloses a subsurface safety valve that is hydraulically controlled from the surface. The well fluid pressure in the drill string or production tubing was manually controlled at the surface for remotely controlling the operation of the subsurface safety valve.

Subsequently, automatic controllers, such as disclosed in U.S. Pat. Nos. 2,785,755; 2,796,133; and 2,831,539, all to Howard EnDean, were utilized to provide automatic control of the subsurface safety valves. These automatic controllers were made responsive to conditions of wind, temperature, loss of pressure from breakage of a well head protective ring and high waves at offshore wells. Also, Natho U.S. Pat. No. RE25,109 disclosed a controller responsive to a number of conditions including a well fluid flow line break for automatically closing the subsurface safety valve.

Some typical surface located automatic control units and their remotely controlled subsurface safety valves are disclosed in the following U.S. Pat. Nos.:

| | |
|---|---|
| Knox | 3,305,808 |
| Tamplen, et al | 2,998,070 |
| Keithahn | 2,998,077 |
| Bostock | 2,897,415 |
| Fredd | Re 25,471 |
| Page | 3,156,300 |
| Taylor | 3,696,868 |
| Page | 3,050,132 |
| Page | 3,065,793 |
| Page | 3,216,501 |
| Sizer | Re 26,149 |
| Taylor | Re 27,464 |
| Lewis | 3,509,913 |

The collective operative essence of these patents is to vent the increased control fluid pressure operably communicative to the subsurface valve through a single control fluid conduit which has overcomes the well fluid pressure for opening the subsurface valve and which when vented enables the subsurface valve to close and shut in the well. If a second or balance control fluid passage was used, as disclosed in Taylor U.S. Pat. No. 3,698,868, the disclosed valve could be closed by increasing the control fluid pressure in the second control fluid passage.

Relevant publications to the present invention include an article by G. M. Raulins entitled "Platform Safety by Downhole Well Control," which appeared in the March, 1972 issue of *Journal of Petroleum Technology,* published by the Society of Petroleum Engineers, Dallas, Texas, and the June 5, 1972 and June 12, issues of *Oil and Gas Journal,* published by Petroleum Publishing Company, Tulsa, Oklahoma, which in a two part article entitled "New Surface-Controlled Downhole Valves" by W. B. Bleakley considers operating features of subsurface safety valves then available from six manufacturers. More detailed descriptions of such valves and their control system may be found in the current and earlier editions of the *Composite Catalog of Oil Field Equipment and Services,* published by World Oil, Houston, Texas.

A Recommended Practice for Design, Installation, and Operation of Subsurface Valve Systems including automatic surface controllers was published in 1973 by the American Petroleum Institute (API). Section 3 of this API publication acknowledge that it is desirable to integrate the automatic controls of the subsurface valve with the surface valve control system, but that no automatic resets which could inadvertently reopen the subsurface safety valve may be incorporated in approved emergency shut-down system.

The controller of the present invention is preferably intended to achieve the desired object of integration with the well surface valve control system using the subsurface valves and operators disclosed in my following U.S. patents and applications but my invention is not to be considered as limited to use with these subsurface valves and operators:

| | |
|---|---|
| 3,744,564 | 3,763,933 |
| 3,750,751 | 3,858,650 |
| 3,762,471 | 3,901,321 |
| Serial No. 580,228, filed May 23, 1975, now Patent No. 4,019,574. | |

In general the operation of my patented valves and operators differs from that disclosed in the prior art patents of others by utilizing increased control fluid pressure in the second or hydraulic balance control line to releasably lock open the tubing retrieval valve (i.e., the valve made up in and which forms a portion of the production tubing and is therefore retrievable with the production tubing) and assist in installing and operating a supplemental through-flow-line (TFL) on wire-line retrieval type valve (i.e., the valve is run through the base of the production tubing for installation or retrieval from the subsurface location using known wire-line or TFL techniques) when the tubing retrieval valve is locked open. These tubing retrieval valves and operators also use the two control lines to achieve a hydraulic balance of the control fluid hydrostatic head which enables the subsurface valve to be set at any depth and establishes the control fluid opening pressure required to open the subsurface safety valve independent of well pressure.

Reference is hereby made to each of the aforementioned patents, applications and publications as well as those to which such specific reference is to be later made for the purpose of incorporating their entire disclosure herein as is set out in full in this specification.

SUMMARY OF THE INVENTION

This invention relates to the field of a new and improved method and apparatus for a surface control system for use in controlling operation of subsurface safety valves in wells.

A surface control system designed for preventing escape of hydrocarbons from the well through the control fluid conduits is provided by using an enclosed control fluid expansible chamber reservoir. The control fluid conduits are effectively connected together by the system to equalize hydraulic control fluid pressure in response to certain conditions sensed by the system for enabling shutting-in of the subsurface safety valve. The system is also arranged to shut-in the subsurface safety valve upon occurence of internal failure of the surface control system. Once the subsurface valve has been closed, it is necessary to manually reset the system to open the subsurface safety valve.

DESCRIPTION OF THE PREFERRED EMBODIMENT

Figure 1:
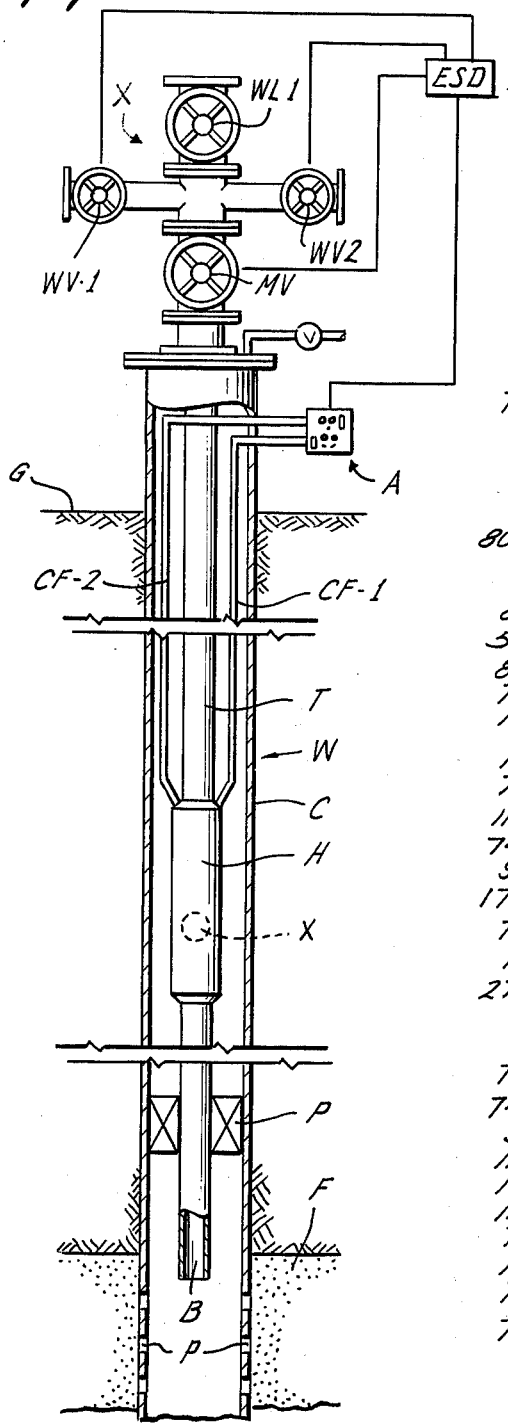
FIG. 1 is a side view, partially in section of a hydrocarbon producing well utilizing the surface controller system of the present invention.
Figure 2:
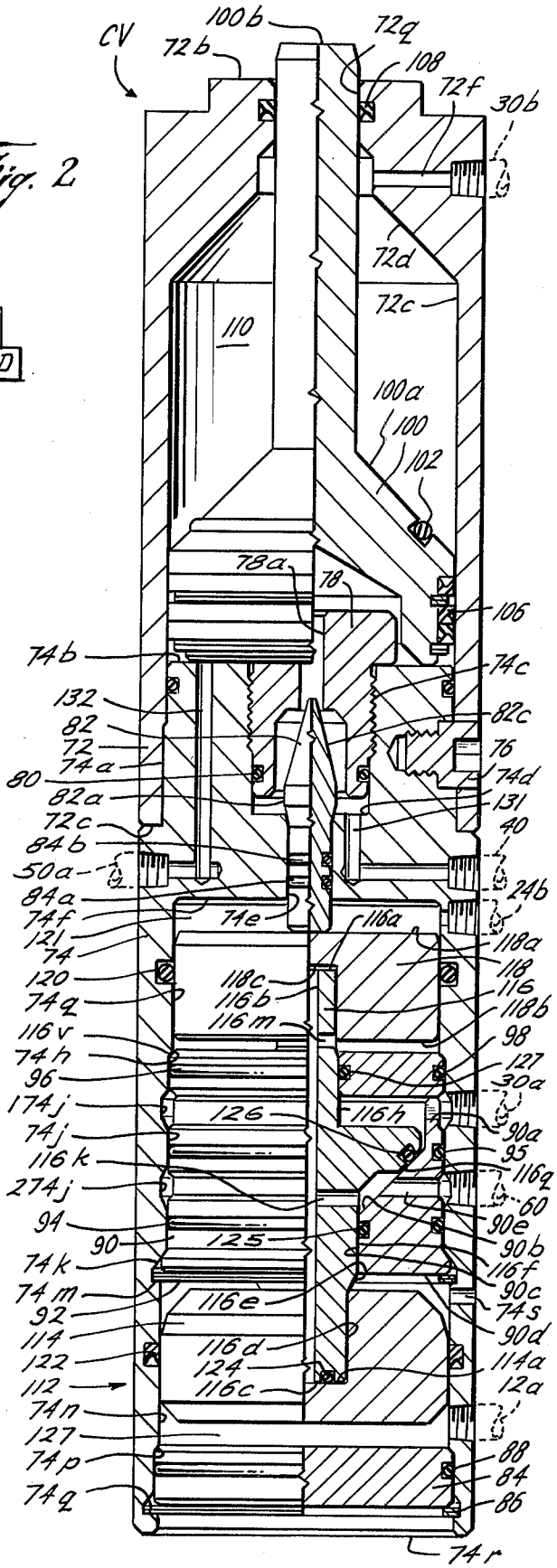
FIG. 2 is a side view, in section, of one embodiment of a controller valve of the surface controller system of the present invention.

A partial cross-section of a typical hydrocarbon producing well W is illustrated in FIG. 1 which extends downwardly from the earth surface G to penetrate a hydrocarbon producing formation F. A cemented well casing C mounts a wellhead or christmas tree assembly X at the earth surface G in the usual manner. Downwardly extending from the christmas tree assembly X is a production tubing T which mounts a packer P adjacent the lower end of the tubing T for effecting a seal between the casing C and the production tubing T. The casing C is perforated with a plurality of perforations P at the producing formation F to enable the well formation fluids including hydrocarbons to flow into the casing C where the packer P will direct upwardly flow of the well fluids through a bore B of the production tubing T to the christmas tree X in the usual manner.

The christmas tree assembly X employs a master valve MV which is connected to the production tubing T and a pair of wind valves WV1 and WV2 that are routinely used to control flow of well fluids from the well. A wire line access valve WL-1 is also preferably provided on the christmas tree X in order that desirable wire line well operations may be performed on the well W as is well known in the art.

While the well W is illustrated in FIG. 1 as a land well, it is to be understood that the well W may be located offshore with the christmas tree assembly X mounted on the producing platform above the water as disclosed in Knox U.S. Pat. No. 3,305,808. It should also be understood that the well head assembly X may be located below the water level or otherwise submerged in the body of water and the flowline controller mounted on a platform remote from the wellhead such as disclosed in my co-pending application Ser. No. 580,228 filed May 23, 1975 and now U.S. Pat. No. 4,019,574.

Connected in and forming part of the production tubing T at a subsurface location in the well W is a subsurface tubing retrievable valve or operator housing H having the rotatable ball closure element, illustrated in phantom and referenced as X in FIG. 1. The construction and operation of the tubing retrievable, the wire-line retrievable and the TFL type subsurface safety valve is disclosed in detail in my aforementioned patents and application which have previously been incorporated herein by reference. It is sufficient understanding of my subsurface safety valves of the purposes of this disclosure that they have a subsurface pressure responsive operator system that performs various functions when a pressure differential urging on the operator system is created. This pressure differential is usually achieved by increasing fluid pressure in one of two independent paths to the valve H.

Extending upwardly from the subsurface valve H and operably connected therewith are control fluid conduits CF-1 and CF-2 which provide the independent paths and which extend upwardly in the well annulus between the tubing T and casing C to a location adjacent the christmas tree assembly X where they extend outwardly through the well casing C to be operably connected to the controller assembly A of the present invention. The control fluid conduit CF-1 is the "normal" control line in that greater control fluid pressure will hold the tubing retrievable subsurface valve H open as long as the greater control pressure is present. In the absence of such greater pressure, the tubing retrievable subsurface valve H will close. The conduit CF-2 is the "lock open" line in that increased control fluid pressure locks the tubing retrievable valve open plus serving as balance line for the hydrostatic head of control fluid in conduit CF-1 and operating the wire-line retrievable or TFL valve when operably installed. While the control lines are illustrated in FIG. 1 as being separate, it is preferred that the control lines be encapsulated in a single unit as disclosed in U.S. Pat. No. 3,844,345.

The surface controller assembly A is connected to a platform power supply system which is normally 100 psig air and is also connected into the platform emergency shutdown system (ESD) which is also normally a pneumatic system that is pressured above 30 psig and with all safety systems - surface and subsurface - arranged to shut in when the ESD pressure drops below 30 psig. Various sensors, such as those previously considered in the prior art, may be used to "trigger" or vent the ESD pressure below the 30 psig level when an undesired condition occurs. The ESD system is operatively connected with the wind valves WV-1 and WV-2 as well as the master valve MV for automatically effecting their emergency closure as is known. The ESD signal will also operate the subsurface safety valve controller assembly A to essentially communicate the normal control fluid line CF-1 with the lock open control fluid line CF-2 to equalize the pressures in those control fluid lines and eliminate the pressure differential urging on the subsurface operator system to enable the subsurface closure element X to shut in the well at the subsurface location.

Figures 3, 4:
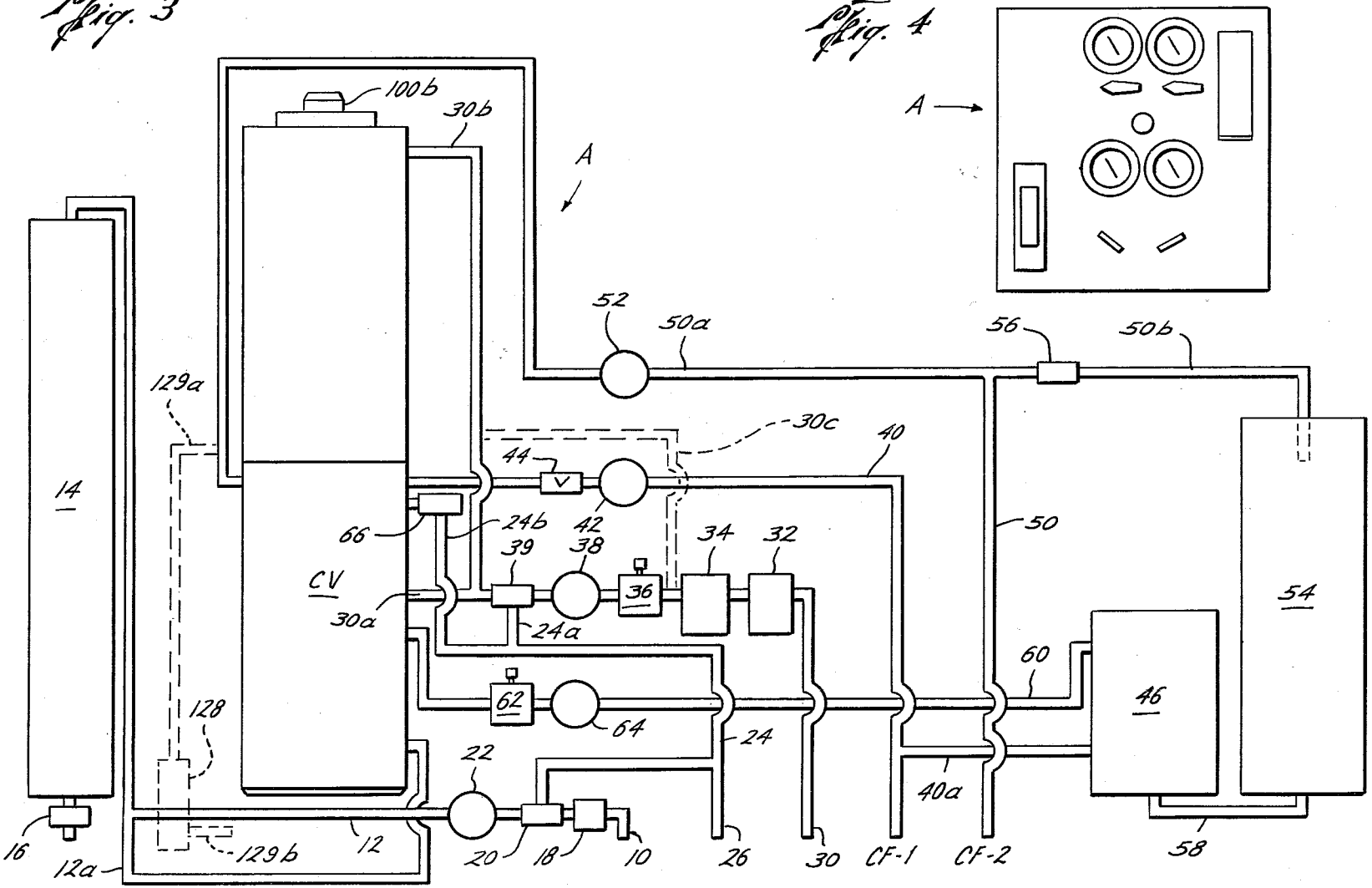
FIG. 3 is a schematic view of the surface controller system of the present invention.
FIG. 4 is a front view of the housing assembly of the surface controller system of the present invention.

The surface controller assembly A is schematically illustrated in FIG. 3 where the emergency shutdown system signal conduit is connected to the controller assembly A at 10 which in turn is connected through conduit 12 with a suitably sized accumulator or volume tank 14 which is provided with a suitable bleed and vent valve 16 for removing any accumulated moisture from the volume tank 14. An orifice or other type of flow restriction 18 is incorporated in the conduit 12 as a buffer or damper to prevent inadvertent operation of the shutdown of the system in response to instantaneous or momentary pressure decreases in the emergency shutdown system. This orifice may also be sized to achieve a delay in the closing of the subsurface safety valve after the surface valves MV, WV-1 and WV-2 have shut in and which delay is desirable for promoting longer life of the subsurface valve.

A suitable manually operated block and bleed valve arrangement, schematically illustrated at 20 is mounted in the shutdown signal conduit 12 and an indicator pressure gauge, illustrated schematically at 22, may be included. Connected with the block and bleed valve arrangement 20 is a vent line conduit 24 that is run to a suitable safe discharge location 26. The emergency shutdown conduit 12 is also connected to the controller valve CV with conduit branch 12*a* as will be more fully described hereinafter. As will become more apparent hereinafter, the valve 20 may be used to manually shut in the well at the subsurface location by blocking conduit 12 while venting the tank 14 and controller valve CV through conduit 24 to effect this automatic operation.

The platform power supply system, usually compressed air at 100 psig, is connected with the controller valve CV by use of the conduit 30. Preferably, a filter 32 and lubricator 34 are mounted in the conduit 30 prior to communicating the air with the controller valve CV. An adjustable pressure regulator 36 is also employed for maintaining a constant supply of air pressure at 75 psig to a controller valve CV. A pressure gauge 38 may also be employed downstream of the pressure regulator 36 to enable operator monitoring of the output pressure of the regulator 36. Also downstream of the regulator 36 is a suitable manually operated block and bleed valve arrangement 39 which is connected with the vent line 24 by conduit 24*a*. Downstream of the block and bleed valve 39, the conduit 30 separates into portions 30*a* and 30*b* which operably communicate with the control valve CV but at different locations for purposes to be described in greater detail hereinafter. Conduit 30*c* may be used as a preferred alternate connector to the conduit 30 in order that the pressure drop of the regulator 36 is bypassed and the full 100 psig air pressure is present in conduit 30*b*. This arrangement is illustrated in phantom in FIG. 3. It is to be understood that other power supply systems and fluids may be utilized with the present invention. For example, a flow line pressure booster unit as illustrated and described at page 4123 of the 1974–75 edition aforementioned *Composite Catalogue* and available from Page Oil Tools, Long Beach, California, may be adapted for use with the present invention as well as their pneumatic power hydraulic booster illustrated at page 4124. Such an adoption to use the well fluid pressure would include recombing the well fluid utilized in the booster unit with the other produced well fluids.

The normal control fluid conduit CF-1 is connected to the controller valve CV with the conduit 40 and which has mounted therewith a pressure gauge 42 and an emergency manually operated block valve 44 that is normally in the open condition. The conduit 40 also is connected through branch 40*a* with the output of an hydraulic pump 46 that may be either manually operated or automatically operated by the air pressure supplied through the controller valve CV as will be more fully described hereinafter.

The lock open control line CF-2 is connected to the conduit 50 and which in turn is connected to the controller valve CV through branch 50*a* mounting the pressure gauge 52. The branch 50*d* connects with a hydraulic fluid reservoir 54, but the branch 50*b* is normally shut in by the valve 56. The control fluid reservoir 54 is in turn connected to the suction or inlet of the hydraulic pump 46 by conduit 58.

The air pressure to operate the hydraulic pump 46 is supplied from the controller valve CV to the pump 46 through the conduit 60. Mounted in the conduit 60 are an adjustable pressure regulator 62 and a pressure gauge 64. The regulator 62 adjusts the air pressure to the pump for controlling the control fluid output pressure of the pump 46. As noted above, other types of fluids to the hydraulic fluid booster units may be used to automatically supply the hydraulic control fluid under pressure.

The vent conduit or line 24 is also connected to the controller valve CV with the branch 24 B having an emergency bleed valve 66 that is normally closed mounted therein.

As illustrated in FIG. 3, the controller valve CV of the present invention is provided with an enclosed housing 70 that is preferably formed for ease of assembly of an upper tubular housing sleeve or section 72 and a lower tubular housing sleeve or section 74 that are threadily engaged (not illustrated) and secured against disassembly by a threaded keeper pin 76.

The upper sleeve 72 forms an upper reduced diameter opening 72*a* adjacent its upper end 72*b* while the lower end 72*c* is formed with a substantially larger diameter opening. A tapered sealing inner surface 72*d* connects the opening 72*a* with the large diameter opening surface 72*e*.

The lower sleeve 74 has a reduced outer diameter portion 74*a* adjacent its upper annular shoulder 74*b* and upon which the threads are formed for securing with the upper housing 72. Adjacent the shoulder 74*b*, a threaded inner surface 74*c* is provided for securing a replaceable seat ring 78 in the usual manner. An O-ring 80 carried by the seat ring 78 forms a fluid seal between the seat ring 78 and the lower housing 74 to block leakage of fluid therebetween in the usual manner.

Adjacent the surface 74*c*, the lower tubular housing 74 is provided with a smaller constant diameter opening portion formed by the surface 74*d* in which a movable valve element 82 is movably positioned and is sealed to the surface 74*d* by O-rings 84*a* and 84*b*. The enlarged head 82*a* of the sliding valve member 82 retains the valve 82 between the sealing surface 74*d* and the seat ring 78. The tapered nose portion 82*c* of the head 82*a* when positioned in the illustrated condition spaced from the seat ring 78 enables flow communication through the opening 78*a* of the seat ring 78. When the tapered nose portion 82*c* engages the seat ring 78 communication through the port or opening 78*b* is blocked, but the unbalanced pressure urging on the valve 82 on both sides of the seat 78 are in a direction to move the valve 82 from engagement with the seat 78. The significance of this will become apparent hereinafter, but this is achieved by the differential area between the seals of the O-rings 84*a* and 84*b* and the seal of the tapered portion 82*c* being exposed to the pressure adjacent the valve 82. The pressure in the port 78*b* urges on the valve 82 over the area bounded by the annular seal of the tapered portion 82*c* with the seal ring 78. The valve 82 when engaging the seat 78 separates the control fluid conduits CF-1 and CF-2 as will be set forth in detail hereinafter.

Located below the valve element sealing surface 74*e* of the lower housing 74 is a downwardly facing annular shoulder 74*f* which connects with a constant diameter inner surface portion 74*g* that extends to a downwardly facing tapered annular lock shoulder 74*h*. Below the lock shoulder 74*h* is an inner surface formed 74*j* that is provided with a pair of annular recesses 174*j* and 274*j* and which terminates in a downwardly facing annular lock shoulder 74*k*. Disposed beneath the lock shoulder 74*k* is an upwardly facing annular locking shoulder 74*m*. Below lock shoulder 74*m* is an inner surface 74*n* formed of a constant diameter which terminates in a downwardly facing tapered annular lock shoulder 74*p*. Disposed below the facing lock shoulder 74*p* is an upwardly facing lock shoulder 74*q* adjacent the lower end 74*r* of the control valve CV.

Fixedly disposed between the lock shoulder 74*p* and 74*q* for enclosing the housing 70 is a removable circular disc or plug 84 which bears against the shoulder 74*p* for blocking further upward movement of the disc 84 into the lower housing 74. A removable radially expansible detent keeper 86 is positioned between the lock shoulder 74*q* and the disc 84 to secure the disc 84 adjacent the lock shoulder 74*p* while an O-ring 88 carried by the disc 84 effects a seal between the disc 84 and the lower housing sleeve 74 to block leakage of fluid therebetween and enclose the controller valve CV.

Engaging the downwardly facing lock shoulder 74*k* is an elongated seat ring member 90 which is secured with the lower sleeve 74 by the releasable radially expansible keeper or detent 92 that operates in a similar manner to the detent 86. O-rings 94 and 94 are carried by the seat ring member 90 to block leakage of fluid at spaced locations between the lower housing sleeve 74 and the ring member 90. The ring member 90 engages ring member 96 with an upwardly extending fluted nose portion 90*a* to also secure the upper fixed ring member 96 in engagement with the lock shoulder 74*h*. The member 96 carries an O-ring 98 for sealing with the lower housing sleeve 74 in a manner similar to that of the O-rings 94 and 95.

The seat ring member 90 is provided with an inwardly tapering sealing surface 90*b* commencing adjacent the nose portion 90*a* and which terminates in a constant diameter inner portion 90*c* adjacent its lower end which is formed by the downwardly facing annular shoulder 90*d*. It will be appreciated that the fluted nose portion 90*a* and a port 90*e* provide fluid communication through the member 90 on both sides of the O-ring 95 to the housing 72.

The controller valve assembly CV further includes movably disposed within the upper operator sleeve 72 a plunger or pressure responsive piston 100 having a downwardly tapering sealing shoulder 100*a* mounting an O-ring 102. When the piston 100 is moved to the upper position (not illustrated) the O-ring 102 effects a seal with the correspondingly tapered shoulder 72*d* of the upper tubular housing 72. The piston 100 also carries packing rings 104 for effecting a continuous sliding seal with the surface 72*d* of the upper tubular housing 72 independently of the position of the piston 100. An O-ring 108 carried by the upper tubular housing 72 effects a seal with the reduced diameter upper portion 102*b* of the piston which slides through the opening 72*a* at the upper end of the upper tubular sleeve 72. With the extension 102*b* extending from the control valve CV a visual indicator as to the position of the piston 100 and operating condition of the entire system is provided as will become more apparent hereinafter.

The seals effected by the packing 106 and the O-ring 108 define an annular expansible chamber 110 that is provided with a port 72*f* which communicates with the conduit 30*b* in order that the 100 psi air pressure is communicated into the expansible chamber 110 for urging the piston 100 downwardly to the illustrated position. The piston 100 is blocked from further downward movement by engagement with the lower tubular housing 74. The hydraulic control fluid pressure in the bore 78*b* of the seat ring 78 will urge the piston 100 upwardly by urging over the entire surface of the piston 100 within the annular seal effected by the packing 106. When the valve 82 is sealed with the seat 78 the control fluid pressure in the conduit CF-2 will urge the piston 100 upwardly. Since during normal operation of the tubing retrievable valve there is only hydrostatic head pressure on the balance control line CF-2, the piston 100 remains in the illustrated lower position. When the piston extension 102*b* moves upwardly the control valve CV indicates to the operator that either an undesired pressure build-up is occurring in the control line CF-2 or the controller valve CV has shut in the subsurface safety valve. When this latter condition occurs the piston 100 moves upwardly to provide an enclosed expansible chamber for the equalized control fluid.

Movably disposed within the lower housing sleeve 74 is a fluid pressure responsive piston means, generally designated 112, preferably formed of three members, - lower piston 114 adjacent the bottom plate 84, a central tubular piston 116 and an upper piston 118.

The upper sealing disc or piston 118 is provided with an upwardly facing annular shoulder 118*a* that engages the sliding valve member 82 with the shoulder 118*a* for moving the valve 82 into sealing engagement with the seat 78 and holding the valve 82 in such engagement. An O-ring 120 maintains a seal between the lower tubular housing 74 and the movable piston ring 118 to block leakage of fluid and form a normally closed expansible chamber 121 above the piston 118. The chamber 121 is in communication with the vent conduit 24*b* to enable venting of the chamber 121 but the valve 66 is normally closed to block venting of the chamber 121 that is initially filled with atmospheric pressure air.

The lower annular surface 118*d* of the piston 118 is formed with a concentric recess 118*c* in which the upper portion of the tubular seat member 116 is movably positioned, but not secured. The engagement of the tubular sealing member 116 with the upper piston 118 effects upwardly movement of the upper piston 118 to move the valve member 82 upwardly to sealingly engage the seat ring 78 as will be more fully described hereinafter. However, it is the 75 psig air pressure urging upwardly on the lower surface 118 of the upper piston 118 which holds the valve 82 against the control fluid pressure and not the upwardly urging of the lower piston 114 on the tubular piston 116.

An annular seal 122 mounted with the lower housing sleeve 74 maintains a seal between the tubular housing 74 and the movable lower piston 114. The piston 114 is provided with a concentric recess 114*a* on its upper surface for receiving a portion of the tubular sealing member 116 in a manner similar to that of the upper sealing member 118.

As mentioned previously, the tubular sealing member 116 engages the upper sealing member 118 with an upwardly facing annular shoulder 116*a* for moving the sealing ring 118 upwardly while a central passageway 116*b* extends the length of the tubular member 116 to the downwardly facing annular shoulder 116*c*. Concentrically mounted on the shoulder 116*c* about the central passageway 116*b* is an O-ring 124 which seals the member 116 with the lower sealing disc 114 when there is engagement therebetween. A lower constant diameter outer surface portion 116*d* fits within the concentric opening 114*a* of the lower piston 114 and extends upwardly to an outwardly tapering portion 116*b* which terminates at constant outer diameter portion 116*f* adjacent fixed ring 90. An outwardly projecting collar formed by the tubular sealing member 116 forms a tapered annular sealing surface 116*g* adapted for engagement with the corresponding tapered sealing surface 90*b* of the fixed member 90. A recess formed in the sealing surface 116*g* carries an O-ring 126 for effecting the desired seal with the member 90. An upper outer surface 116*h* is formed by a constant diameter portion of the tubular member 116 is sealingly engaged by an O-ring 128 carried by the fixed ring member 96 for effecting a seal therebetween. O-rings 125 and 126 carried by members 90 and 98 seal with tubular piston 116 in a manner to provide a small downwardly facing unbalanced pressure responsive surface that is sufficient to hold the tubular piston 116 and upper piston 118 in the upper position, but which is inadequate to hold against the control fluid pressure urging on valve 82.

The tubular piston 116 has a port 116*m* which communicates the central bore 116*b* with the area below the upper piston 118 for holding the upper piston 118 in the upper position with the 75 psig pressure through port 74*s* from below the upper piston when the seal by O-ring 124 between the lower piston 114 and the tubular piston 116 is broken.

As previously noted the expansible chamber 118 formed by the movable piston 110 in the upper chamber is exposed to the 100 psig air supply by conduit 30*b* through conduit 30*c*. That air supply pressure is reduced to the 75 psig by the regulator 36 and is also communicated through the conduit 30*a* into the expansible chamber formed below the fixed sealing ring 98 and closed by the O-ring 126 sealingly engaging the surface 90*b*. When the tubular piston 116 is moved to the upper position spacing the sealing shoulder 116*g* and O-ring 126 from the sealing member 90, the 75 psig air supply pressure is also communicated through the port 90*e* to the conduit 60 which leads to the actuator for the pump 60. Thus, when the member 116 is in the upper position the air supply to power the pump 60 is communicated from the conduit 30 into the conduit 60 by the controller valve CV. When the member 116 moves to the lower and illustrated position the power supply to the hydraulic pump 60 is terminated and it is necessary to either manually operate the hydraulic pump or manually reset the controller valve CV to pressure up the control lines CF-1 and CF-2 and open the subsurface safety valve H.

A port 74*s* formed in the lower tubular sleeve 74 vents the expansible chamber disposed below the stationary sealing ring 90 and the lower piston 114 to atmosphere and accordingly only atmospheric pressure is urging the lower piston 114 to move downwardly. Located below the lower piston 114 is an expansible chamber 130 which communicates with the 30 psig emergency shutdown signal system through conduit 12*a* and accordingly the 30 psig signal, when supplied, urges the member 114 upwardly. The upward movement of the member 114 is transmitted through the tubular member 116 and upper movable sealing ring 118 to move the valve element 82 upwardly into engagement with seat ring 78. The magnitude of the upward urging is controlled by the sizing of the lower piston 114 and is insufficient to hold the valve 82 against the control fluid pressure.

The automatic ability to prevent the instrument from resetting should pressure in the chamber 130 be decreased and then inadvertently increased is effected in the following manner. When the pressure in the chamber 130 is reduced below 30 psig the member 116 moves to the illustrated position which breaks the seal by O-ring 124 between the tubular piston 116 and the lower piston 114. When this occurs the 75 psi pressure urging upwardly on the member 116 is vented to atmosphere through port 74*s* and the tubular piston 116 moves downwardly to effect a seal with the O-ring 126 with the member 90. This seal makes the upwardly facing shoulder 116*j* pressure responsive to the urging of the 75 psig air and which urging is greater than that provided by the 30 psig shut down signal reintroduced into the chamber 130 and which thereby maintains the tubular piston 116 in the lower position. The 75 psi back pressure on the side of the seal 126 adjacent port 60 that is normally communicated to the hydraulic pump is also dumped to atmosphere by passing inwardly to the center passageway 116*b* of the member 116 also for venting through port 74*g*.

With the pressure in the conduit 30 blocked in and bled off by the valve 39, the introduction of the signal pressure through the conduit 12*a* into the chamber 127 will effect upward movement of the members 114, 116 and 118 which in turn move the valve member 82 upwardly to engage the seat ring 78 due to the absence of control fluid pressure. With the engagement with the seat ring 78 by the valve member 82, the valve 39 may be opened for operating the pump without the effecting system shutdown.

The 75 psig air is communicated into the housing 72 and through the flutes 90*a* and on into the bore 116*b* of the tubular piston 116 through the ports 116*k* and then outwardly through port 116*m*. The upwardly urging of the 75 psig air pressure on the upper piston 118 then provides a sufficient force to hold the valve 82 against the seat 78 when the control fluid pressure is increased by the pump 46 to open the subsurface valve H. It will also be appreciated that any ambient pressure air trapped in chamber 121 above the upper piston 118 will be compressed.

The normal control line CF-1 is connected by the conduit 40 to the control valve CV and is communicated therein by internal porting 131 to a location adjacent and below the seat 78 and on the valve 82 side of the seat 78. The lock open line CF-2 is communicated through the conduit 50*a* with the control valve CV. In turn, the conduit 50*a* is communicated through internal posting 132 to a location below the piston 100 and above the seat ring 78 and on the opposite side of the seat 78 from the valve 82.

As mentioned previously, the control fluid pressure also urges upwardly on the movable piston 100 below the seal 106. Thus it will be immediately appreciated that as long as the valve member 82 sealingly engages with the seat ring 78 communication between the lock open line CF-2 and the normal control fluid line CF-1 is prevented and subsurface safety valve operating pressure differential between the two control lines may be maintained. When the valve 82 is moved from sealing engagement with the seat ring 78 the control fluid pressure in the control line CF-1 and CF-2 is immediately equalized and the subsurface safety valve H enabled to close.

It will also be appreciated that the shape of the valve member 82 is such that both the normal control fluid pressure and the lock open line control fluid pressure tend to urge the valve member 82 from engagement with the seat 78 and any desired pressure increase above a desired level in either line will unseat the valve 82 to enable the subsurface safety valve H to close.

Furthermore, the control fluid pressure will urge the piston 100 upwardly to provide an enclosed reservoir for the displaced equalized pressure hydrocarbon control fluid when the subsurface safety valve H closes.

An alternate embodiment of protection against an undesired increase in control fluid pressure in the lock open line CF-2 is illustrated in phantom in FIG. 3. In this embodiment a known high pressure pilot valve 128, such as the model YLH pressure sensor available from Axelson, Inc. of Longview, Texas is mounted in the emergency shut down signal conduit 12 for forming a normal flow path through the pilot valve 128 in order that the pilot valve 128 will operate to shut in the ESD signal supply and vent the ESD signal in the controller valve CV and accumulator 14 to shut in the system. The pressure sensor of the pilot valve 128 is connected using conduit **129*b* with the conduit 50*a* communicating with the lock open control fluid conduit CF-2 for sensing that control fluid pressure. The discharge or vent port of the valve 128 may be connected into the vent conduit using the partially illustrated conduit 129*b*. The pilot valve 128 is set so that when control fluid pressure in the lock open line increases to a preselected pressure of 50 psig, for example, the valve 128 will be actuated to the vent position and thereby block the conduit 12 from further supply of the emergency shut down signal will bleeding the 30 psig pressure from the volume tank 14 and the ESD chamber 127 of the controller valve CV through conduit 129*b*. The advantage of the greater sensitivity of the pilot valve 128** for triggering the 30 psig emergency shut down signal when control fluid pressure builds up in CF-2 is a definite advantage for unattended surface controller installation.

Figure 6:
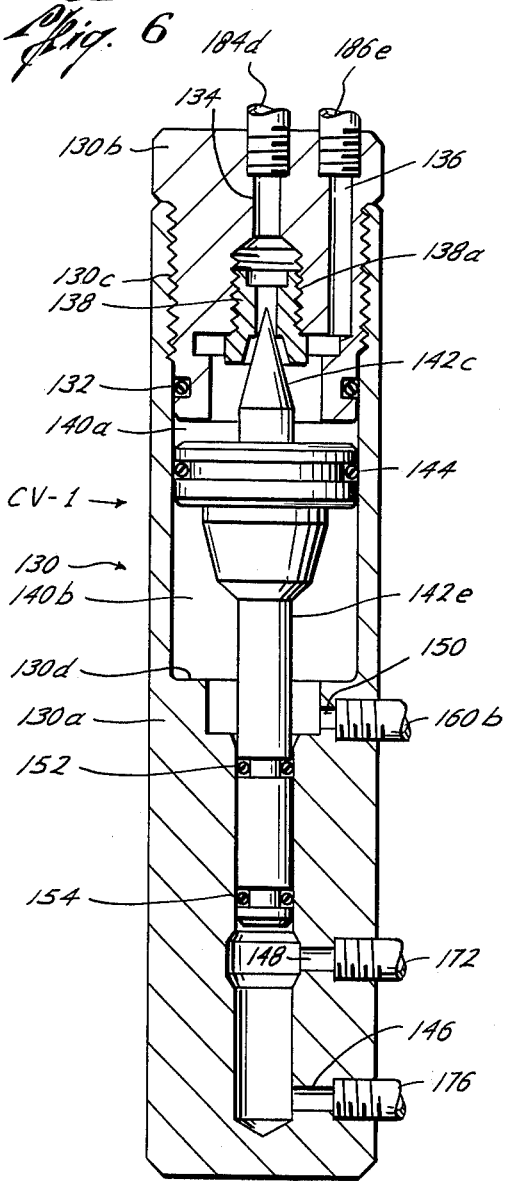
FIGS. 6 and 6A are views similar to FIG. 2 illustrating a second embodiment of a controller valve in the different operating conditions.
Figure 6A:
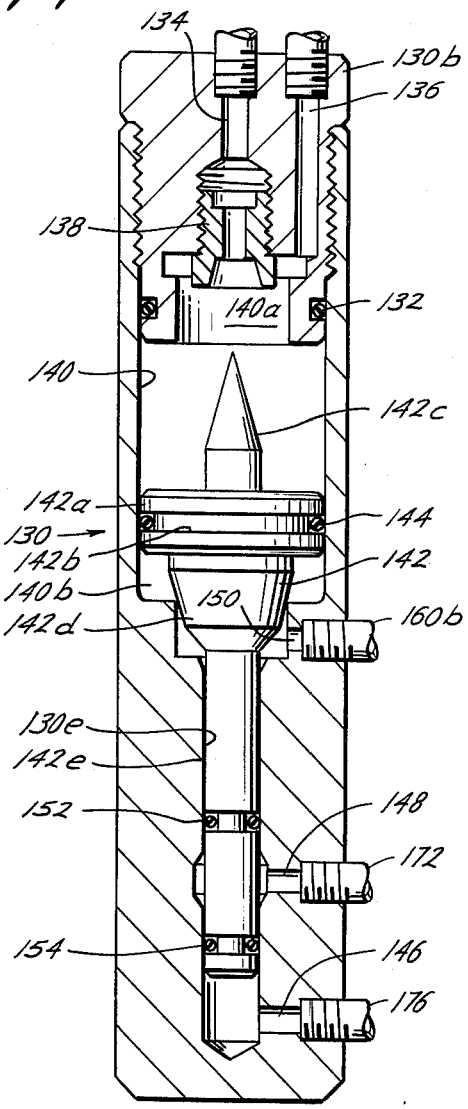

A second somewhat simplified embodiment of a controller valve CV-1 is illustrated in FIGS. 6 and 6A. The controller valve CV-1 is provided with a tubular enclosed housing 130 which is preferably formed, for ease of assembly, of an elongated portion **130*a* and a cap 130*b*** that are secured together by threaded engagement at 130*c*. An O-ring 132, adjacent the threaded engagement at **130*c***, prevents leakage of fluid therebetween to provide the fluid retaining enclosed housing.

The threaded cap portion **130*b* of the housing 130 is provided with a central passageway 134 and an eccentric fluid passage 136. Secured concentrically with the concentric passageway 134 is a seat ring 138 which is treadedly secured to the cap 130*b* by threaded engagement at 138*a*. As best illustrated in FIG. 6A flow passages 134 and 136 communicate with the enclosed elongated cavity or fixed volume or capacity chamber 140 of varying diameters formed by the tubular housing 130** and the normal control fluid conduit CF-1 and vent control fluid conduit CF-2, respectively, as will be detailed hereinafter.

Movably disposed within the fixed volume chamber 140 is a fluid pressure responsive piston means, generally designated 142, that is preferably formed in a single unit, but which may be formed in various components which may be secured together in the desired manner for ease of assembly. The piston means 142 is reciprocally movable in the elongated cavity or chamber 140 between the lower position of FIG. 6A and the upper position illustrated in FIG. 6 which separates control fluid conduits CF-1 and CF-2 for holding the subsurface valve open.

The piston 142 includes a collar **142*a* that carries an O-ring 144 in a recess 142*a* for effecting a fluid seal between the piston collar 142*a* and the tubular housing 130 to form variable volume or expansible chambers 140*a* and 140*b* above and below collar 142*a* when the piston 142 reciprocates. Disposed above the collar 142*a* is a concentric conical tapered sealing portion 142*c* adapted to sealingly engage the seat ring 138 when the piston 142 is in the position illustrated in FIG. 6 for preventing communication of the control fluid between the flow passages 134 and 136 above the O-ring 144 in expansible chamber 140*a***.

Disposed below the collar **142*a* is a downwardly facing tapered sealing surface 142*d* that is adapted to engage and seal with upwardly facing shoulder 130*d* of the lower tubular member 130*a* when in the lower position illustrated in FIG. 6A. Disposed below the upwardly sealing shoulder 130*d* the fixed chamber 140 is reduced to a smaller diameter cross section formed by the constant diameter inner surface 130*e***.

Also disposed below the sealing shoulder **130*d* is a plurality of flow ports or passageways communicating with the chamber 140 for enabling flow into and out of the fixed chamber. The 100 psig air outlet passageway 146 communicates with the fixed chamber 140 at a location below the piston means 142 when in either position. A 100 psig air inlet passageway 148 is disposed slightly above the outlet passageway 146 while the 30 psig emergency shut down signal inlet passageway 150 communicates with the fixed chamber 140 below the sealing shoulder 130*d***.

The piston means 142 is provided with a downwardly projecting extension **142*e* from the sealing shoulder 142*d* and having a constant diameter outer surface substantially filling the portion of the chamber 140 formed by the constant diameter surface 130*e* of the tubular housing 130. The collar 142*a* and the constant diameter extension 142*e* guide the piston means 142 in its longitudinal reciprocating movement in the tubular housing 130**.

A pair of longitudinally spaced O-rings 152 and 154 are carried on the extension **142*e* for effecting seals with the surface 130*e* to block leakage of fluid therebetween in the usual manner. The O-rings 142 and 154 serve to block communication with the piston means 142 between the ESD signal passageway 150 and the passageway 172 when the piston is in the upper position of FIG. 6. When the piston 142 moves to the lower position of FIG. 6A, the O-rings 152 and 154 effect fluid seals between ports 146, 148 and 150** to block any fluid communication therebetween.

Due to such sealing arrangement, the pressure responsive piston 142 is made subject to the following pressures urging thereon when the piston is illustrated in the upper portion of FIG. 6. With the tapered sealing piston means 142*c* engaging the seat ring 138 the normal operating control fluid pressure in the central flow passage 134 urges downwardly on the central portion of the piston 142 inside the seal with the seat ring 138. Vent line control fluid pressure in the eccentrically located upper passage 136 is communicated into upper expansible chamber 140*a* for also urging downwardly on the piston 142 on the annular pressure responsive area between the seal effected by the seat ring 138 and the O-ring 144. The shut down signal pressure in the conduit 150 below the sealing shoulder 130*d* urges upwardly on the piston 144 over the pressure responsive surface between the seal effected by the O-ring 144 and the constant diameter surface of the extension 142*e*. The fluid pressure present in the conduits 148 and 146, which are in communication when the piston is in the condition illustrated at FIG. 6, also urges upwardly on the bottom of the piston stem 142*e* for urging the piston upwardly. In general, the fluid pressures present above O-ring 144 urge the piston 142 to move downwardly while the pressures below O-ring 144 hold the piston 142 in the upper position of FIG. 6.

When the piston 142 moves to the lower position illustrated in FIG. 6A, control fluid passageways 134 and 136 above O-ring 144 are placed in communication by the sealing surface 142*c* moving from engagement with the seat ring 138. Accordingly, the control fluid pressure is equalized between passageways 134 and 136 for closing the subsurface safety valve and the resulting equalized control fluid pressure urges downwardly on the piston means 142 over the entire upwardly facing pressure responsive area inside the seal effected by the O-ring 144. With the piston 142 in the lower position, the lower tapered sealing surface 142*d* engages the seal shoulder 130*d* and accordingly the emergency shut down signal pressure in the passageway 150 urges upwardly on the piston means over the reduced pressure responsive annular area between the seal effected between the shoulder 130*d* and the sealing surface 142*d* and the outer diameter of the stem 142*e*. This reduction in pressure responsive area upon operation prevents the piston 142 from moving upwardly for automatically resetting the system and opening the subsurface safety valve. The pressure in the inlet passageway 148 is blocked from communication with the outlet passageway 146 by the change in position of the O-ring 154 while O-ring 152 blocks communication of that pressure to the passageway 150. The outlet pressure present at passageway 146 urges upwardly on the extension 142, but is reduced sufficiently not to be able to lift the piston 142.

Figure 5:
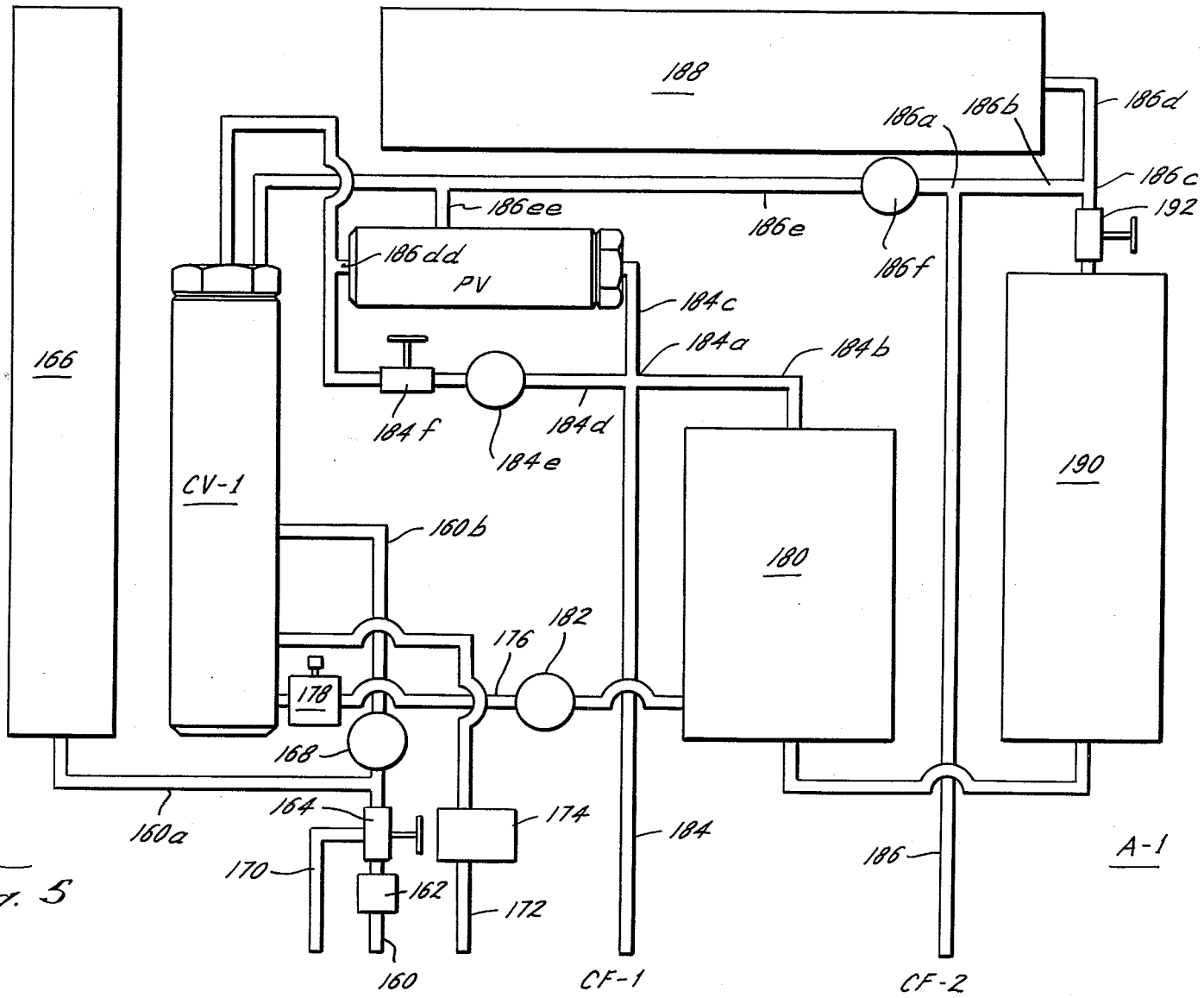
FIG. 5 is a view similar to FIG. 3 of a second embodiment of the surface controller system of the present invention.

The control valve CV-2 is preferably installed at a surface controller assembly A-1, schematically illustrated in FIG. 5 and which is substantially similar to the surface controller assembly A of FIG. 3. The 30 psig air emergency shutdown signal is connected to the conduit 160 where it is passed through a delay orifice 162 and a block and bleed valve 164. The conduit 160 splits into branch conduits 160*a* and 160*b* after passing through the block and bleed valve 164. The conduit 160*a* communicates with a volume tank or accumulator 166 which provides a sufficient reservoir of 30 psig air signal to prevent inadvertent shutdown of the system as a result of pressure pulse fluctuation in the emergency shutdown signal. The conduit 160*b* in turn communicates with the port 150 and expansible chamber 140*b* of the controller valve CV-2 for using the 30 psig emergency shutdown signal to urge upwardly on the pressure responsive piston means 142. A pressure gauge 166 may be utilized to monitor the presence of the emergency shutdown signal. The block and bleed valve 164 is preferably provided with a vent line 168 for venting the conduit 160*a* and 160*b* as well as the reservoir tank 166 when the block and bleed valve 164 is used to manually shut down the system A-1 and the subsurface safety valve.

The 100 psig power air supply is connected to the conduit 172 where it passes through a line filter 174 before being communicated into the inlet passageway 148 of the control valve CV-1. When the piston 142 is in the upper position (FIG. 6) the 100 psig air is placed in communication with outlet port 146 and also urges the piston 142 upwardly. When the piston 142 is in its lower position (FIG. 6A), the piston extension 142*e* and O-rings 152 and 154 block communication of the 100 psig air into the chamber 140 where it can urge upwardly on the piston 142 or communicate with outlet port 146.

The passageway 146 of the control valve CV-1 communicates with the conduit 176 having a regulator 178 for controlling the pressure through the conduit 176 to pneumatic operated hydraulic pump 180 for the hydraulic control fluid. A pressure gauge 182 may be installed in the conduit 176 to monitor the down stream pressure controlled by the regulator 178.

The normal control fluid conduit CF-1 is connected to the conduit 184 having a four-way junction at 184*a*. The branch 184*b* connected with the junction 184*a* is connected to the discharge of the control fluid hydraulic pump 180 outlet which supplies control fluid under pressure to the conduit 184 in response to the pneumatic actuation supplied to the pump 180 through the conduit 176 from the controller valve CV-1. The branch 184*c* connected with the junction 184*a* leads to a pilot valve PV for a purpose to be described in greater detail hereinafter. The branch 184*d* is also connected to the four-way junction 184*a* and leads to the controller valve CV-1 where it communicates through the upper concentric passageway 134 with the upper expansible chamber 140*a*. The conductor 140*d* is provided with a branch 184*dd* that is also connected with the pilot valve PV as will be explained in greater detail hereinafter. The conductor 184*d* may be provided with a pressure gauge 184*e* and a start up manually operated valve 184*f*. The manner in which the manually operated valve 184*f* enables opening of the subsurface safety valve and start up of the system will be considered hereinafter with respect to the pilot valve PV.

The conduit 186 is connected with the lock open line CF-2 leading to the subsurface safety valve housing H and is provided with a T connector at 186*a*. A branch 186*b* leads to another T 186*c* which communicates through another branch 186*d* to an accumulator tank 188. The T connection 186*c* is also connected to the hydraulic fluid reservoir 190. Lock valve 192 is normally set to the closed position to prevent flow from the lock open lines into the accumulator 188 and block flow of control fluid from the lock open line CF-2 into the hydraulic fluid reservoir. Also connected with the junction 186*a* is branch conduit 186*c* that is in turn connected through the flow port 136 of the controller valve CV-1 to the expansible chamber 140*a*. A pressure gauge 186*f* may be installed in the conduit 186 to enable monitoring of the pressure in the lock open control fluid conduit CF-6.

Figure 7:
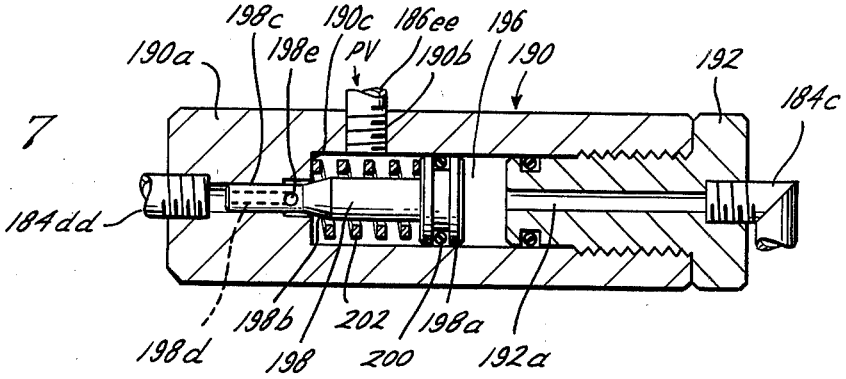
FIG. 7 is a side view, in section, of a simplified pilot valve of the present invention.

The pilot valve PV in the present invention is illustrated in greater detail in FIG. 7. The pilot valve PV includes a tubular housing 190 and a tubular cap 192 threadedly secured together at 193. A O-ring 194 prevents leakage along the threaded engagement at 193 to provide an enclosed housing.

The housing 190 forms a fixed volume elongated central cavity 196 with the housing 190 having a pair of flow ports 190*a* and 190*b* for communicating to and from the cavity 196. The flow port 190*a* is connected to the normal operating control fluid stub 184*dd* while the flow port 190*b* communicates with the vent control fluid conduit extension 186*ee*. The housing cap 192 is also provided with a central flow passage 192*a* that also communicates with the normal operating control fluid conduit 184*c*.

Movably disposed within the cavity 196 is a fluid pressure responsive piston 198 having at one end a collar 198*a* carrying on O-ring 200 for effecting a fluid seal between the movable piston 198 and the housing 190. The piston 198 is provided with a conically tapered seating or sealing surface 198*b* adjacent a guide portion 198*c* that is disposed in the flow passage 190*a*. The guide portion 198*c* is provided with a central port 198*d* having an outlet 198*e* disposed adjacent the smaller diameter portion of the tapered sealing surface 198*b*.

When the piston 198 is reciprocated in the cavity 196 in a first direction to the position illustrated in FIG. 7 the sealing surface 198*b* engages an annular seal shoulder 190*c* for blocking communication between the flow passage of ports 190*a* and 190*b*. It should be noted, however, that the pressure present in port 190*a* is communicated through the central passage 198*d* and outlet port 198*e* of the piston means 190 in order that the pressure in the passageway 198 urges on the piston 198 over the pressure responsive area within the seal effected between the seal shoulder 190*d* and the tapered sealing shoulder 198*b* of the piston means 198 for urging the piston 198 to reciprocate or move to a second position. The pressure in the port 190*a* then urges on the piston 198 in a direction for breaking the seal between the shoulder 190*c* and the sealing surface 198*b* and placint the control fluid conduits in communication through the valve. The urging of the normal control line pressure in passageway 190*a* is more than offset however by the same normal control line pressure being communicated through the conduit 184*c* into the expansible chamber 196 where it urges on the piston means 198 in the opposite direction over the larger pressure responsive surface area defined by the seal of the O-ring 200 with the housing 190*a*. As long as the same control fluid pressure is maintained on both sides of the piston means 198 the net pressure urging of the normal control fluid pressure is to maintain the piston 198 in sealing contact with the seal shoulder 190*c*.

During start up of the system when opening the safety valve H, it is necessary to initially close valve 184*f* in under and to place the increased control fluid pressure in port 184 only to insure the pilot valve PV remains closed. Otherwise the spring 202 will be sufficient to overcome the initial increase in normal control fluid pressure and hold the pilot valve V open and prevent the necessary differential pressure build up between the conrol fluid conduits DF-1 and CF-2.

Concentrically mounted about the piston 198 is a biasing spring means 202 that is disposed between the seal shoulder 190*c* and the piston collar 198 for urging the piston 198 from sealing engagement with the seal shoulder 190*c*. The urging of the spring 202 coupled with the lock open control line pressure present at the port 190*b* adds to the normal control fluid pressure present at the port 190*a* for urging piston 198 from sealing engagement with the shoulder 190*c*. The spring constant or strength of spring 202 is selected to determine the necessary pressure build up in the vent line that will be sufficient to overcome the partially balanced urging of the normal control fluid pressure on the piston 198 with the valve H fully open. This prevents any undesired pressure build up in the lock open control fluid line that could lock open the safety valve H by closing of the subsurface safety valve in the aforementioned manner when lock open control fluid pressure begins to build up. The use of the pilot valve in conjunction with the control valve CV-2 enables tying together of the normal conrol fluid lines CF-1 and CF-2 at a smaller increase in the lock open control fluid pressure line than is available from the control valve CV-1. However, should the pilot valve PV fail to operate, the controller valve CV-1 is arranged to be forced downwardly by a sufficient pressure build up in the lock open line for triggering the subsurface safety valve to shut in.

OPERATION

In the use and operation of the present invention, the tubing retrievable valve or operator housing H is made up in the production tubing T in the usual manner. After connecting the control line CF-1 and CF-2 the tubing T is run in the well W in the usual manner. When the subsurface safety valve H is at its desired location, the packer P is set and the christmas tree X mounted on the well case C. The surface valves MV, WV-1 and WV-2 are installed along with the wireline valve WL-1. The surface valves are then hooked up to the emergency shutdown system in the usual manner.

The control fluid conduits CF-1 and CF-2 are connected to the controller apparatus A in the previously described manner. The well apparatus A is connected to the emergency shutdown system 30 psig signal as well as the 100 psig air supply using conduits 12 and 30, respectively.

Frequently, the subsurface safety valve H is run into the housing in the lock open condition and it may be necessary to manually pressure up the control fluid concuit CF-2 to effect the release of the subsurface safety valve from the lock open condition. The well is then completed by swabbing or the like in the usual manner.

The desired sequence for shutting in the well W is to close the wing valves WV-1 and WV-2 first and then the master valve MV. Last of all the subsurface safety valve H is shut-in. In opening operations, the sequence is reversed with the subsurface safety valve H being opened first, followed by the master valve MV before opening the wing valves WV-1 and WV-2. This is, of course, prevent the master valve MV and subsurface safety valve H from having to close on a flowing stream that could damage the valve.

To activate the controller system A, the 30 psig emergency shutdown signal is communicated to the controller valve CV by opening the block valve 20. This pressure is thus communicated to the conduit 12*a* into the chamber 130 where it moves the lower piston 114 upwardly. As the piston 114 moves upwardly the tubular piston 116 and the upper piston 118 are moved upwardly and their movement also effects upward movement of the valve element 82 into sealing engagement with the seat 78. Engagement of the valve element 82 with the seat 78 separates the control fluid line CF-1 from the control line CF-2 and enables the differential pressure build up in the normal control line CF-1 for opening the subsurface safety valve H. As previously described, the upward movement of the tubular piston 116 spaces the O-ring 126 fom the sealing surface 90b for enabling communication of the 75 psig supply air from the conduit 30a into the conduit 60 where it communicates to both the air actuated hydraulic pump 46 for pressuring up the conduit CF-1 with the control fluids in the reservoir 54 and the upper piston 118. When the pump 46 output of control fluid reaches the desired operating pressure of 2500 psig in the conduit CF-1 the subsurface safety valve H opens. The setting of the regulator 62 controls the control fluid output pressure of the pump and automatically holds the output pressure level constant.

When pressuring up the normal control line CF-1 the only pressure on the control line CF-2 will be the 100 psig air in the upper chamber 110 urging downwardly on the piston 100 on any control fluid trapped above the seat ring 78. Preferably this pressure is vented using valve 56 and no pressure is present in conduit CF-2.

The surface controller apparatus A of the present invention will actuate to shut in the subsurface safety valve H when any one of the following four trigger conditions occur:

1. Loss of the 30 psig emergency shut down signal;
2. An undesired pressure build-up occurs in the normal control fluid line CF-1;
3. An undesired pressure build-up occurs in the lock open line CF-2; and
4. An internal seal leak in the controller valve CV.

The loss of the emergency shutdown signal to the controller valve in chamber 130 enables the piston 114 to move downwardly and thereby venting the 75 psig air urging on the tubular piston 116 and upper piston 118 and triggering their downward movement for shutting of the air supply to the pump 46. The normal control fluid pressure urging on the valve element 82 will then space the valve element 82 from the seat 78 for equalizing the control fluid pressure between the control fluid conduit CF-1 and CF-2 and shutting in the subsurface safety valve H in a manner set forth in greater detail previously.

A packing leak in the subsurface valve H may result in an undesired pressure build up in either control line. When this occurs in the normal control fluid conduit CF-1 the resulting increased downwardly during on the valve element 82 will overcome the upwardly urging of the 75 psig air pressure on the piston 118 for spacing the valve element 82 from the seat 78 in order that the control fluid conduit CF-1 and CF-2 are equalized for closing the subsurface safety valve in the aforementioned manner.

When the undesired pressure build-up occurs in the lock open conduit CF-2 that pressure also urges the valve element 82 downwardly for overcoming the urging of the emergency shut down signal in the chamber 130 for equalizing the control fluid pressure between the conduit CF-1 and CF-2 for shutting in the subsurface safety valve H. If the pilot valve 128 is utilized it will interrupt the emergency shut down signal in the manner previously described to in order that the absence of that signal will actuate the system for closing the valve.

The undesired pressure build-up in either line can occur for a number of reasons, but they may result from a packing leak in the subsurface safety valve H which enables the well fluid pressure to be communicated under blow out conditions through the control line conduits CF-1 and CF-2 to the surface. However, the controller valve CV provides an enclosed reservoir below the piston 100 for receiving the control fluid and which enclosed system will contain any well blow outs through the control line CF-1 and CF-2.

The fourth condition upon which the surface controller system A of the present invention will operate in the subsurface safety valve H is an internal seal failure in the controller valve CV. For instance, if the seals effected by the packing 122 or the O-ring 88 fail for any reason the 30 psig emergency shut down signal in the expansible chamber 130 holding the piston 114 upwardly will be vented to atmosphere and the piston 114 will move downwardly to effect shut in of the subsurfaces safety valve H. Due to the volume supply of 75 psig air, failure of most of the O-rings containing a 75psig air will only vent to atmosphere and will not effect operation of the controller valve. However, should O-ring 120 fail the pressure urging on piston 118 is equalized and the system will shut in as piston 118 will not then hold valve 82 against seat 78.

Leakage of the control fluid by the seal effected by the O-ring 80 or between the seat ring 78 and the valve element 82 will tend to equalize control fluid pressure and enable the valve H to close. Loss of control fluid pressure in the control fluid conduit CF-1 past O-rings 84a and 84b carried by the valve element 82 will urge the upper piston 118 downwardly and will close the subsurface safety valve H.

Leakage of the 100 psig air around the seal 106 carried by the piston 100 will introduce the air into the control fluid conduit CF-2 but will not be of sufficient pressure in control fluid conduit CF-2 to effect closing of the subsurface safety valve H unless pilot valve 200 is used. However, such leakage will cause the piston 100 to perhaps rise and give a visual indication that something is wrong with the system. Normally the indicator 102b when moved to the upper position by the piston 100 indicates that the subsurface safety valve H has been closed.

When the tubing retrieval valve H is locked open and the wire-line or TFL valve operably installed as disclosed in my aforementioned patents and applications the connection of the control fluid conduits CF-1 and CF-2 is revented. This is necessary since the lock open line CF-2 became the "normal" control line.

The operation of the second embodiment is done in substantially the same manner as the embodiment just disclosed. The minor differences therebetween in operation are known to those of ordinary skill in the art.

The foregoing disclosure and description of the invention are illustrative and explanatory thereof, and various changes in the size, shape and materials as well as in the details of the illustrated construction may be made without departing from the spirit of the invention.

We claim:

1. A surface control system for use with a surface controlled subsurface safety valve in a well, including:

a controller housing;

means with said controller housing for communicating with a supply of fluid under pressure for powering the surface controller system;

means with said controller housing for communicating with an emergency shut down signal for the well thereto;

means with said controller housing for communicating with a first control fluid conduit that operably communicates with the subsurface safety valve;

means with said controller housing for communicating with a second control fluid conduit that operably communicates with the subsurface safety valve for balancing the hydrostatic head of the control fluid in the first control fluid conduit;

controller valve means mounted in said controller housing valve means for selectively communicating said first control fluid conduit with said second control fluid conduit; and means responsive to the presence of an emergency shut down signal for maintaining said controller valve means in a closed position blocking communication of said first control fluid conduit and said second control fluid conduit, said means for maintaining said controller valve means in a closed position operable in the absence of said emergency shut down signal for enabling said valve means to open and thereby communicate said first control fluid conduit with said second control fluid conduit wherein control fluid pressure in said first and said second control fluid conduits is equalized to enable the subsurface safety valve to shut in the well.

2. The apparatus as set forth in claim 1, including:

means in said controller housing responsive to the pressure of said emergency shut down signal for containing the supply of fluid under pressure in said housing, said means for containing responsive to the absence of said emergency shut down signal for operably venting the fluid under pressure from said controller housing;

means in said controller housing responsive to the venting of the fluid under pressure from said housing for preventing further supply of the fluid under pressure for powering the surface controller system until the system is reset.

3. The apparatus as set forth in claim 2, wherein:

said means for maintaining said controller valve means in the closed position having means responsive to the contained supply of fluid under pressure for maintaining said controller valve means in the closed position, said means responsive to the contained supply of fluid under pressure disposed that the venting of fluid under pressure from said controller housing removes the pressure urging for maintaining said controller valve means in the closed position for enabling the controller valve means to open and communicate the control fluid conduits for equalizing the control fluid pressure.

4. The apparatus as set forth in claim 1, including:

piston means movably disposed in said controller housing and forming first and second expansible chambers within said controller housing, said piston means movable in response to the differential pressure in said first and second expansible chambers;

said first expansible chamber communicating with said means for communication with the supply of fluid under pressure for power the surface controller system for providing a constant urging on said piston means; and said second expansible chamber communicating with said means for communication with the second control fluid conduit for forming an enclosed reservoir for the control fluid.

5. The apparatus as set forth in claim 2, wherein:

said means for containing the supply of fluid under pressure in said housing including a movable vent piston member having oppositely facing first and second pressure responsive surfaces;

said means for communicating with the emergency shut down signal formed in said controller housing for urging on said first pressure responsive surface of said vent piston to move said vent piston to a position for containing the supply of fluid under pressure in said housing; and said means for communicating with the supply of fluid under pressure formed in said controller housing for urging on said second pressure responsive surface to said vent piston to move said vent piston to a position for venting the supply of fluid under pressure from said housing.

6. The apparatus as set forth in claim 5, wherein said first pressure responsive surface is of a greater area than the area of said second pressure responsive surface.

7. The apparatus as set forth in claim 5, including:

said means responsive to the venting of the fluid under pressure including a valve piston having oppositely facing first and second pressure responsive surfaces and movable between an open position for enabling supply of the fluid under pressure for powering the surface controller system and a closed position for preventing supply of the fluid under pressure;

said means for communicating with the supply of fluid under pressure formed for enabling communication of the fluid under pressure to said valve piston;

said first and second pressure responsive surfaces formed on said valve piston that when the valve piston is in the opening position the fluid under pressure urges in the first pressure responsive surface for maintaining the valve piston in the open position while offsetting the urging on the second pressure responsive surface, said first pressure responsive surface responsive disposed that the venting of the fluid under pressure enables the valve piston to move to the closed position and activating the second pressure responsive surface for maintaining the valve piston in the closed position.

8. The apparatus as set forth in claim 7, wherein:

said means for maintaining said controller valve in the closed position including a biasing piston movably disposed in said housing between a controller valve open position and a controller valve closing position, said biasing piston having a pressure responsive surface upon which the urging of fluid pressure moves said biasing piston to the controller valve closing position; and said means for communicating with a supply of fluid under pressure arranged to urge on the pressure responsive surface of said biasing piston for closing the controller valve unitl the supply of fluid under pressure is vented.

9. The apparatus as set forth in claim 3, wherein:

said means for containing the supply of fluid under pressure in said housing including a movable vent piston member having oppositely facing first and second pressure responsive surfaces;

said means for communicating with the emergency shut down signal formed in said controller housing for urging on said first pressure responsive surface of said vent piston to move said vent piston to a position for containing the supply of fluid under pressure in said housing; and said means for communicating with the supply of fluid under pressure formed in said controller housing for urging on said second pressure responsive surface to said vent piston to move said vent piston to a position for venting the supply of fluid under pressure from said housing.

10. The apparatus as set forth in claim 9, including:

said means responsive to the venting of the fluid under pressure including a valve piston having oppositely facing first and second pressure responsive surfaces and movable between an open position for enabling supply of the fluid under pressure for powering the surface controller system and a closed position for preventing supply of the fluid under pressure;

said means for communicating with the supply of fluid under pressure formed for enabling communication of the fluid under pressure to said valve piston;

said first and second pressure responsive surfaces formed on said valve piston that when the valve piston is in the opening position the fluid under pressure urges in the first pressure responsive surface for maintaining the valve piston in the open position while offsetting the urging on the second pressure responsive surface, said first pressure responsive surface rsponsive disposed that the venting of the fluid under pressure enables the valve piston to move to the closed position and activating the second pressure responsive surface for maintaining the valve piston in the closed position.

11. The apparatus as set forth in claim 8, further including:

said controller valve means having a fixed valve seat and a movable valve member having first pressure responsive surface and a second pressure responsive surface for moving said movable valve member from sealing engagement with said seat in response to the fluid pressure urging on said first and second pressure responsive surfaces;

said means for maintaining said controller valve means in the closed position urging said movable valve member into sealing engagement with said fixed seat.

12. A method of controlling the operation of a subsurface safety valve having two independent control fluid passages extending upwardly from the valve to a surface controller including the steps of:

increasing the control fluid pressure in one of the two independent control fluid passages to provide a pressure differential to open the subsurface safety valve to enable flow from the well;

interrupting a reference signal to the surface controller in response to the sensing of an undesired condition; and communicating the independent control fluid passages at the surface control to equalize the pressure differential in the control fluid passages to enable the subsurface safety valve to close.

13. The method as set forth in claim 12, including receiving the equalized control fluid pressure in an expansible chamber in the surface controller for preventing a well blow out through the control fluid passages.

14. The method as set forth in claim 12, including the step of:

deactivating the surface controller in response to the interrupting of the reference signal to prevent a return of the reference signal to keep the surface controller from automatically opening the subsurface safety valve.

15. A method of operating a well having a surface controller for a subsurface safety valve disposed in the well and having two independent control fluid conduits communicating the subsurface safety valve with the surface controller including the steps of:

providing a reference signal to the surface controller;

increasing the control fluid pressure in one of the control fluid conduits communicating with the subsurface safety valve to open the subsurface safety valve;

flowing well fluids from the well through the subsurface safety valve;

terminating the reference signal to the controller in response to a sensed undesired condition;

communicating the two independent control fluid conduits with the surface controller for equalizing the control fluid pressure; and closing the subsurface safety valve in response to the equalized control fluid pressure.

16. The method as set forth in claim 15, including deactivating the surface controller in response to the terminated reference signal to prevent automatic opening of the subsurface safety valve upon the return of the reference signal.

* * * * *